United States Patent [19]

Dawson et al.

[11] Patent Number: 4,985,170

[45] Date of Patent: Jan. 15, 1991

[54] IN BETA-PHASE BAR FORM CONTAINING SOAP, HIGH HLB NONIONIC SURFACTANT, AND WATER-SOLUBLE POLYMER

[75] Inventors: Geoffrey G. Dawson, Ponteland; Gordon Ridley, Cramlington, both of England

[73] Assignee: The Procter & Gamble Company, Cincinnati, Ohio

[21] Appl. No.: 253,808

[22] Filed: Oct. 5, 1988

[30] Foreign Application Priority Data

Oct. 9, 1987 [GB] United Kingdom ..... 8723776

[51] Int. Cl.[5] ..... C11D 9/30; C11D 13/14

[52] U.S. Cl. ..... 252/117; 252/108; 252/132; 252/134; 252/174.18; 252/174.23; 252/174.24; 252/DIG. 16

[58] Field of Search ..... 252/108, 117, 132, 174.23, 252/174.24, 174.18, DIG. 16

[56] References Cited

U.S. PATENT DOCUMENTS

| | | | |
|---|---|---|---|
| 2,686,761 | 8/1954 | Ferguson et al. | 252/109 |
| 2,970,116 | 1/1961 | Kelly et al. | 252/368 |
| 3,562,167 | 2/1971 | Kamen et al. | 252/121 |
| 4,265,778 | 5/1981 | Sonenstein | 252/117 |
| 4,285,826 | 8/1981 | Bertozzi et al. | 252/117 |
| 4,490,280 | 12/1984 | Joshi et al. | 252/368 |
| 4,493,786 | 1/1985 | Joshi | 252/368 |
| 4,547,307 | 10/1985 | Hoppe et al. | 252/107 |
| 4,678,593 | 7/1987 | Ridley | 252/131 |
| 4,719,030 | 1/1988 | Williams et al. | 252/133 |
| 4,812,253 | 3/1989 | Small et al. | 252/132 |
| 4,820,447 | 4/1989 | Medcalf et al. | 252/117 |
| 4,828,752 | 5/1989 | Nagarajan et al. | 252/174.24 |

FOREIGN PATENT DOCUMENTS

| | | |
|---|---|---|
| 580206 | 7/1959 | Canada . |
| 186148 | 7/1986 | European Pat. Off. . |
| 2182343 | 5/1987 | United Kingdom . |

*Primary Examiner*—Prince E. Willis

*Attorney, Agent, or Firm*—Robert B. Aylor; Richard C. Witte

[57] ABSTRACT

Toilet compositions in beta-phase bar form comprising 45% to 90% $C_{8-24}$ fatty acid soap, 0.5% to 45% of ethoxylated nonionic surfactant, and 0.01% to 5% of a water-soluble polymer. The compositions have improved scum-control uncharacteristics with excellent mildness, smear, lathering and transparency/translucency.

17 Claims, No Drawings

IN BETA-PHASE BAR FORM CONTAINING SOAP, HIGH HLB NONIONIC SURFACTANT, AND WATER-SOLUBLE POLYMER

TECHNICAL FIELD

This invention relates to toilet compositions in the form of bars, tablets, sticks and the like. In particular, it relates to toilet compositions in at least part beta-phase form having improved scum control characteristics with excellent mildness, lathering and transparency/-translucency.

BACKGROUND

A wide variety of soap bar compositions and manufacturing processes are known in the art. Commonly, soap bar compositions for toiletry purposes are milled soaps of low moisture content (from about 5% to about 18% water) based on a mixture of tallow and coconut oil feedstocks. Bars having milled soap characteristics can also be prepared from soap of a high moisture content, as described for example in U.S. Pat. No. 2,686,761 and U.S. Pat. No. 2,970,116 by mechanically working the soap at a temperature of from about 80° F. to 125° F. and by using an appropriate fat feedstock. Such a process has two main advantages; firstly, it is relatively energy-efficient in that less drying of the neat-kettle soap is required; and secondly, it produces soap bars having desirable translucency or transparency as a result of beta-phase soap formation.

From the consumer acceptance viewpoint, of course, the lathering and mildness characteristics of a toilet bar composition are highly important and there is a continuing need to improve these areas of performance. Traditionally, lather enhancement has been achieved in two ways. Firstly, shorter chain fatty acid soaps such as coconut soaps are known to produce a much richer lather than longer chain fatty acid soaps such as those based on tallow and it is therefore common practice in toilet bar manufacture to add up to 50% coconut soap to the tallow fat feedstock. Secondly, superfatting agents such as coconut fatty acid also improve the volume and richness of the lather when added to toilet bars in levels of up to about 10%. At higher levels, however, coconut soaps increasingly have a detrimental effect on bar mildness while fatty acids can produce undesirable softening of the bar. Moreover, coconut soaps and fatty acids are both expensive commodities and it would therefore be desirable to achieve improvements in lathering without recourse to high levels of these ingredients.

In the case of beta-phase soaps, moreover, there is a more fundamental difficulty in achieving high lathering through the use of coconut soaps and superfatting agents. Fat feedstocks which are relatively rich in shorter chain (less than 16 carbon atoms) saturated fatty acids inhibit the formation of beta-phase soap and are therefore unsuitable for making transparent or translucent soap bars. In a similar way, beta-phase soap formation is also inhibited by the addition of free fatty acid superfatting agents in levels above about 1%-3%.

EP-A-0222525 in the name of the present Applicant addresses the problem of improving the lathering characteristics of beta-phase toilet bar compositions and advocates the incorporation of certain water-soluble polymer materials for this purpose. A major draw-back of these polymer additives, however, is their tendency to promote formation of scum under hard water conditions, an effect which is particularly noticeable and undesirable when the toilet compositions are used during bathing. While EP-A-0222525 generally recognise this problem and teaches the value of synthetic surfactants for controlling scum formation, nevertheless, one specific class of surfactant material has now been identified which is almost uniquely effective in its ability to control scum, which simultaneously provides benefits in other areas of bar performance, notably reduced smear characteristics and improved processing and stamping, and which at the same time allows for excellent lathering, mildness and beta-phase soap (transparency/translucency) characteristics.

SUMMARY OF THE INVENTION

Accordingly, the present invention provides a beta-phase toilet bar composition comprising:

(a) from about 45% to about 90% by weight of soluble alkali metal soap of $C_8$–$C_{24}$ fatty acids, (b) from 0.5% to about 45% of an ethoxylated nonionic surfactant having an HLB in the range from about 12 to about 19.5, and (c) from about 0.01% to about 5% of a water-soluble polymer.

The present invention relates to toilet bar compositions in beta phase form containing a water-soluble polymer and a hydrophilic nonionic surfactant material. In general terms, the compositions contain from about 45% to about 90% of soluble alkali metal soap of $C_8$–$C_{24}$, preferably $C_{10}$–$C_{20}$ fatty acids and from 0.5% to 45% of the ethoxylated nonionic surfactant, In highly preferred compositions, the soap component constitutes from about 55% to about 80% and the nonionic surfactant from about 0.5% to about 15% more preferably from about 1% to about 8% by weight of the composition. Especially preferred are milled toilet bar compositions which are essentially unbuilt (i.e. contains less than about 5% of a water-soluble surfactancy builder).

All percentages and ratios herein are by weight, unless otherwise specified.

Fatty acid soaps suitable for use herein can be obtained from natural sources such as, for instance, plant or animal esters (e.g., palm oil, coconut oil, babassu oil, soybean oil, castor oil, tallow, whale or fish oils, grease, lard, and mixtures thereof) The fatty acid soaps can also be synthetically prepared (e.g., by the oxidation of petroleum, or by the hydrogenation of carbon monoxide by the Fischer-Tropsch process) Resin acids, such as those present in tall oil, may be used. Naphthenic acids are also suitable.

Sodium and potassium soaps can be made by direct saponification of the fats and oils or by the neutralization of the free fatty acids which are prepared in a separate manufacturing process. Particularly useful in the present invention are the sodium and potassium salts of mixtures of fatty acids derived from coconut oil and tallow, i.e., sodium and potassium tallow and coconut soaps.

Tallow fatty acids can be derived from various animal sources and generally comprise about 1% to 8% myristic acid, about 21% to 32% palmitic acid, about 14% to 31% stearic acid, about 0% to 4% palmitoleic acid, about 36% to 50% oleic acid and about 0% to 5% linoleic acid. A typical distribution is 2.5% myristic acid, 29% palmitic acid, 23% stearic acid, 2% palmitoleic acid, 41.5% oleic acid, and 3% linoleic acid.

Coconut oil refers to fatty acid mixtures having an approximate carbon chain length distribution of: 8% $C_8$, 7% $C_{10}$, 48% $C_{12}$, 17% $C_{14}$, 8% $C_{16}$, 2% $C_{18}$, 7% oleic and 2% linoleic acids (the first six fatty acids listed being saturated). Other sources having similar carbon chain length distributions, such as palm kernel oil and babassu kernel oil, are included within the term coconut oil. Coconut oil fatty acids ordinarily have a sufficiently low content of unsaturated fatty acids to have satisfactory keeping qualities without further treatment. Generally, however, fatty acids are hydrogenated to decrease the amount of unsaturation (especially polyunsaturation) of the fatty acid mixture.

The compositions herein generally take the form of a toilet bar wherein the soap is at least partially in beta-phase form. Beta-phase soap crystals have a smaller lattice dimension than delta and omega soap phases and are associated with a typifying 6.35cm X-ray diffraction ring. The relative amount of beta-phase in the toilet bars of the invention can be determined by comparing the relative intensities of the beta, delta and omega diffraction rings against those of known standard soap phase mixtures (see U.S. Pat. No. 2686761). In preferred embodiments, therefore, the soap is preferably at least about 20%, more preferably at least about 50% and especially at least about 70% in the beta-phase form. In highly preferred compositions, the bar is a milled toilet bar and is transparent or translucent, preferably having a translucency voltage (see U.S. Pat. No. 2970116 and EP-A-0014502) of less than about 110, preferably less than about 60 , more preferably less than about 45. It is a feature of the present invention that the polymeric materials can be incorporated in such bars without substantially impairing transparency.

The soap fat stock for making bars which are predominantly beta-phase is of some importance and desirably the fat stock comprises no more than about 40% thereof of saturated fatty acids of less than 16 carbon atoms and at least about 20% thereof of saturated fatty acids of from 16 to 22 carbon atoms. In preferred compositions, the fat stock comprises no more than about 30% of the shorter chain saturated fatty acids and at least about 70% of the longer chain saturated fatty acids. The moisture content of the finished beta-phase bar is generally from about 15% to about 26% by weight, preferably from about 20% to about 24%.

The compositions herein also contain an ethoxylated nonionic surfactant. The surfactant is valuable for improving formulation characteristics in the area of scum formation under hard water usage conditions. It is a feature of the invention that both the ethoxylated nonionic surfactant and polymer can be incorporated in the compositions of the invention without detriment to beta phase formation and bar transluency. Preferred from the viewpoint of scum dispersion are ethoxylated nonionic surfactants having a hydrophilic balance (HLB) of from about 10 to about 19.5, preferably from about 15 to about 19.2 more preferably from about 17 to about 19, HLB being defined in the usual manner as W/5, where W is the weight % of ethylene oxide per mole of surfactant. The level of surfactant is preferably from about 0.5% to about 15%, more preferably from about 1% to about 8%.

Preferred ethoxylated nonionic surfactants for use herein have a melting point in the range of from about 32° C. to about 90° C., preferably from about 35° C. to about 70° C. The melting point is taken herein to refer to the temperature at which the melting is completed and is conveniently measured by thermal analysis using a Dupont 910 Differential Scanning Calorimeter with Mechanical Cooling Accessary and R90 Thermal Analyser as described for example in EP-A-0142910.

Preferred nonionic surfactants herein are the condensation products of primary and secondary fatty alcohols having from about 8 to about 24, preferably from about 15 to about 24 atoms in either straight or branched chain configuration, with from about 10 to about 200, preferably from about 15 to about 150 moles of ethylene oxide per mole of alcohol. Examples of surfactants of this type are the condensation products of hardened tallow alcohol with an average of between 11 and 100 moles, preferably about 80 moles of ethylene oxide per mole of alcohol, the tallow portion comprising essentially between 16 and 22 carbon atom; and the condensation products of staight branched chain $C_{15}/C_{16}$ fatty alcohols with an average of from 8 to 25 moles of ethylene oxide per mole of alcohol.

A further essential component of the beta-phase toilet bar compositions is a polymer. The polymer should be soluble or dispersible in water to a level of at least 1% by weight - preferably at least 5% by weight at 25° C. Suitable polymers are high molecular weight materials (mass-average molecular weight determined, for instance, by light scattering, being generally from about 20,000 to about 5,000,000, preferably from about 50,000 to about 4,000,000, more preferably from 500,000 to about 3,000,000). In viscosity terms, suitable polymers are those having a thickening ability such that a 1% dispersion of the polymer in water at 20° C. exceeds about 1 Pa.s (1000 cps), preferably at least 2 Pa.s (2000 cps) at a shear rate of $10^{-2}sec^{-1}$. A suitable apparatus for determining the viscosity is a Haake RV12 Rotovisco Viscometer.

Polymers useful in the present invention are the cationic, nonionic, amphoteric and anionic polymers useful in the cosmetic field. Preferred are cationic and nonionic resins and mixtures thereof. Highly preferred are the cationic resins. The level of polymer is from about 0.01% to about 5%, preferably from about 0.1% to about 2% by weight. In preferred embodiments, the polymer forms a water-soluble 'poly-salt' complex with the anionic soap/surfactant components.

Cationic polymers suitable in the present invention are selected from cationic polysaccharides, homopolymers of dimethyldiallyl ammonium chloride, copolymers of dimethyldiallyl ammonium chloride and acrylamide, cationic homopolymers and copolymers derived from acrylic acid and/or methacrylic acid, polyalkylene imines and ethoxy polyalkylene imines, and mixtures thereof. Of these, preferred cationic polymers are cationic guar gums, for example, hydroxyproxyltrimethylammonium guar gum, quaternized cellulose ethers, quaternized vinylpyrrolidone acrylate or methacrylate copolymers of aminoalcohol, copolymers of dimethyldiallyl ammonium chloride and acrylamide, homopolymers of dimethyldiallyl ammonium chloride, and mixtures thereof. A highly preferred cationic polymer herein is a copolymer of dimethyldiallyl ammonium chloride and acrylamide.

By way of exemplification, cationic polymers preferred for use herein include hydroxypropyl trimethyl ammonium guar gum (d.s. of from 0.11 to 0.22) available commercially under the trade names Jaguar (RTM) C-17 and C-15 and also Jaguar C-16(RTM) which contains hydroxypropyl substituents (d.s. of from 0.8–1.1) in addition to the above-specified cationic groups, quaternized cellulose ethers available commercially under the trade names Ucare Polymer JR and Celquat, homopolymers of dimethyldiallyl ammonium chloride available commercially under the trade name Merquat 100, copolymers of dimethyl aminoethylmethacrylate and acrylamide, copolymers of dimethyldiallyl ammonium chloride and acrYlamide available copolymers commercially under the trade names Merquat 550 and Merquat S and quaternized vinyl pyrrolidone acrylate or methocrylate copolymers of amino alcohol available commercially under the trade name Gafquat.

Nonionic polymers suitable for use herein are selected from guar gum, hydroxypropyl guar gum, methyl cellulose, methyl hydroxypropyl cellulose, hydroxypropyl cellulose, locust bean gum, starch, starch amylose, hydroxyethylamylose and polyoxyethylene and mixtures thereof. Highly preferred nonionic polymers are guar gum and hydroxypropyl guar gum having a degree of substitution of from about 0.3 to about 1.2, for example, Jaguar (RTM) HP-60 and HP-8 from Meyhall Chemical Ltd in which the degree of substitution is about 0.6.

In addition to the components described above, the toilet bars of the present invention can contain a wide variety of optional materials. These optional materials include, for example, skin conditioning components, processing aids, anti-bacterial agents and sanitizers, dyes, perfumes and coloring agents.

Materials to facilitate the preparation of the instant toilet bars can also be present. Thus, glycerine, for example, can be added to the crutcher or amalgamator in order to facilitate processing. Glycerine, if present, generally comprises from about 0.2% to about 10% by weight of the finished bar. Additionally, emulsifiers such as polyglycerol esters (e.g. polyglycerol monostearate), propylene glycol esters and other chemically stable nonionic materials may be added to the bars to help solubilize various components, particularly skin conditioning agents, such as sorbitan esters.

Conventional anti-bacterial agents and sanitizers can be added to the bars of the present invention. Typical anti-bacterial sanitizers include 3,4-di- and 3',4',5-tribromosalicyl-anilides; 4,4'-dichloro-3-(trifluoromethyl) carbanalide; 3,4,4'-tri-chlorocarbanalide and mixtures of these materials. Use of these materials in soap bars is described in more detail in U.S. Pat. No. 3,256,200. If present, anti-bacterial agents and sanitizers generally comprise from about 0.5% to about 4% by weight of the finished bar.

The bars of the present invention can optionally contain various emollients and skin conditioning agents. Materials of this type include, for example, sorbitan esters, such as those described in U.S. Pat. No. 3,988,255, lanolin, cold cream, mineral oil, isopropyl myristate, and similar materials. If present, such emollients and skin conditioning agents generally comprise from about 0.5% to about 5% by weight of the bar.

The toilet bars herein can also contain an electrolyte as described in U.S. Pat. No. 2686761and EP-A-l4502. Suitable electrolytes include sodium chloride, potassium chloride, potassium carbonate, dipotassium monohydrogen orthophosphate, tetrasodium pyrophosphate, tetrapotassium pyrophosphate, sodium tripolyphosphate, potassium tripolyphosphate, trisodium orthophosphate, tripotassium orthophosphate, and sodium and/or potassium formates, citrates, acetates and tartrates, and mixtures of the above. The electrolyte level is from about 0.2% to about 4.5%.

The toilet bars of the invention can also contain free fatty acid, in addition to the neutralized fatty acids which form the actual soap component. Free fatty acids are especially valuable as plasticizers. Without the free fatty acids, some bars have a greater tendency to form wet cracks. The free fatty acid content should be restricted to less than about 1%–2% by weight, however.

Acidic materials can be added to the bar to control free alkalinity. A suitable example is citric acid added at a level of about 0.1% to about 3%.

Another desirable ingredient of the compositions of the invention is a pearlescent material such as mica, titanium-dioxide coated mica, natural fish silver, or heavy metal salts such as bismuth oxychloride. It is a feature of the invention that the polymers described herein can be incorporated in such compositions without detriment to the development of pearlescence.

The toilet bars can also contain any of the conventional perfumes, dyes and coloring agents generally utilized in commercially-marketed bars to improve the characteristics of such products. If present, such perfumes, dyes and coloring agents comprise from about 0.2% to about 5% by weight of the bar.

The compositions of the invention are prepared in conventional manner, either from neat kettle soap or from saponified touch-hardened fatty acid blends. In a typical process, neat kettle soap containing the ethoxylated nonionic surfactant and from about 28% to about 34%, preferably from about 30% to about 32% moisture is dried, preferably by Mazzoni spray drying, such as to give a moisture content of from about 15% to about 26%, preferably from about 19% to about 25%, more preferably from about 21% to about 23% expressed as weight of finished product, the water-soluble polymer is added to the dried soap/surfactant mix, either as a powder or as an aqueous solution or dispersion and the dried soap/surfactant/polymer mix is mechanically worked at an elevated temperature, for example, in an amalgamator or over milling rolls, until the temperature is raised into the range from about 27° C. to about 51° C., preferably from about 37° C. to about 43° C., more preferably from about 39° C. to about 41° C. Thereafter, the soap mass is plodded into bar form. The optional bar components, other than perfume, dye and pearlescer which are added in the amalgamator, are preferably admixed with the neat kettle soap prior to the drying stage. In an alternative, though less preferred process, the polymer can be added to the neat kettle soap prior to drying—

In the examples which follow, the following abbreviations have been made.

P1 Merquat (RTM)550—Copolymer of acrylamide and dimethyldiallyl ammonium chloride, weight average mol.wt $2.5\times10^6$ (8% aq. solution).

P2 Jaguar (RTM) C15—hydroxypropyl trimethyl ammonium guar gum.

P3 Jaquar HP-60—hydroxypropyl guar gum.

EXAMPLES I TO VI

Soap bar compositions according to the invention are prepared as described above in which sodium tallow/coconut (80/20) kettle soap is mixed with the nonionic surfactant and all remaining ingredients, apart from perfume, dye, $TiO_2$, mica and polymer, the mixture is dried in a Mazzoni spray dryer, the dried soap surfactant mixture is admixed with the remaining components in an amalgamator, the polymer being added either in dry form or as 20% active solution or as a 60% active/40% water prill, the mixture is then milled at about 40° C. to optimize beta-phase soap formation, and finally plodded into bar form. The compositions are as follows:

| | I | II | III | IV | V | VI |
|---|---|---|---|---|---|---|
| Sodium tallow/coconut (80/20) soap (anhydrous) | 57.4 | 62.2 | 67.5 | 61.6 | 66.4 | 60.8 |
| Potassium cocoate soap | 4 | — | — | 3 | — | 4 |
| Tripotassium citrate monohydrate | 2.5 | 2 | 2.5 | 1.5 | 2.5 | 3 |
| Tallow alcohol $(EO)_{80}$ | — | — | 3 | — | — | 1 |
| Tallow alcohol $(EO)_{25}$ | — | — | — | 3 | 4 | — |
| Tallow alcohol $(EO)_{11}$ | 7 | — | — | 4 | — | — |
| $C_{15}/C_{16}$ alcohol $(EO)_8$ | — | 6 | — | — | — | 3 |
| Sodium chloride | 0.4 | 0.8 | 0.4 | 0.3 | 0.4 | 0.5 |
| Glycerine | 4 | 7 | 4 | — | 4 | 5 |
| EDTA | 0.2 | 0.3 | 0.2 | 0.1 | 0.2 | 0.1 |
| Lauric Acid | 0.8 | 0.2 | 0.8 | 0.5 | 0.6 | 1 |
| $TiO_2$ coated mica | 0.1 | 0.1 | 0.1 | 0.1 | 0.1 | — |
| Perfume and dye | 2 | 1.3 | 1.4 | 1 | 2.2 | 1.9 |
| P1 | — | — | 0.5 | — | 0.5 | — |
| P2 | — | 2 | 1 | — | 1 | 0.5 |
| P3 | 5 | — | — | 1 | — | 0.5 |
| Moisture | | | | 100 | | |

The above compositions are beta-phase toilet soaps having improved scum control characteristics, both in soft and hard water, as well as excellent lathering, translucency, smear, cleansing performance, and enhanced skin-feel characteristics.

What is claimed is:

1. A beta-phase toilet bar composition comprising:
(a) from about 45% to about 90% by weight of soluble alkali metal soap of $C_8$–$C_{24}$ fatty acids,
(b) from 0.5% to about 45% of an ethoxylated nonionic surfactant having an HLB in the range from about 12 to about 19.5, and
(c) from about 0.01% to about 5% of a water-soluble cationic polymer.

2. A composition according to claim 1 wherein at least about 20% by weight of the soap is in the beta-phase.

3. A composition according to claim 2 wherein at least about 50% by weight of the soap is the beta-phase.

4. A composition according to claim 3 wherein at least about 70% by weight of the soap is the beta-phase.

5. A composition according to claim 4 in the form of a milled transparent or translucent toilet bar.

6. A composition according to claim 5 comprising soap of a fat stock no more than about 40% of which are saturated fatty acids of less than 16 carbon atoms and at least about 20% of which are saturated fatty acids of from 16 to 22 carbon atoms.

7. A composition according to claim 6 having a water content of from about 15% to 26% by weight.

8. A composition according to claim 1 wherein the polymer is selected from the group consisting of cationic polysaccharides, homopolymers of dimethyldiallyl ammonium chloride and acrylamide, cationic homopolymers and copolymers derived from acrylic acid and/or methacrylic acid, polyalkylene imines and ethoxy polyalkylene imines, and mixtures thereof.

9. A composition according to claim 1 wherein the cationic polymer is selected from the group consisting of cationic guar gums, quaternized cellulose ethers, quaternized vinylpyrrolidone acrylate or methacrylate copolymer of aminoalcohol, copolymers of dimethyldiallyl ammonium chloride and acrylamide, homopolymers of dimethyldiallyl ammonium chloride, and mixtures thereof.

10. A composition according to claim 1 wherein the cationic polymer is selected from the group consisting of quaternized cellulosic ethers, copolymers of dimethyldiallyl ammonium chloride and acrylamide, and mixtures thereof.

11. A composition according to claim 1 comprising from 0.5% to 15% of the ethoxylated nonionic surfactant.

12. A composition according to claim 11 comprising from 1% to 8% of the ethoxylated nonionic surfactant.

13. A composition according to claim 12 wherein the nonionic surfactant has an HLB of from about 15 to about 19.2.

14. A composition according to claim 13 wherein the nonionic surfactant has an HLB of from about 17 to 19.

15. A composition according to claim 1 wherein the nonionic surfactant is selected from the group consisting of condensation products of primary or secondary fatty alcohols having from about 8 to about 24 carbon atoms with from about 10 to about 200 moles of ethylene oxide per mole of alcohol.

16. A composition according to claim 15 wherein the nonionic surfactant has a melting point in the range of from about 35° C. to about 70° C.

17. A process of making a toilet bar composition according to claim 1 wherein neat kettle soap containing the ethoxylated nonionic surfactant and from 28% to 34% moisture is dried to a moisture content of from 15% to 26%, the water-soluble polymer is added to the dried soap/surfactant mix, the dried soap/surfactant/polymer mix is mechanically worked at an elevated temperature until the temperature is raised into the range from 27° C. to 51° C., and the soap is thereafter plodded into bar form.

* * * * *